US008678568B2

(12) United States Patent
Masunaga

(10) Patent No.: US 8,678,568 B2
(45) Date of Patent: Mar. 25, 2014

(54) IMAGE FORMING APPARATUS

(71) Applicant: Suguru Masunaga, Kanagawa (JP)

(72) Inventor: Suguru Masunaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/772,882

(22) Filed: Feb. 21, 2013

(65) Prior Publication Data

US 2013/0235129 A1 Sep. 12, 2013

(30) Foreign Application Priority Data

Mar. 12, 2012 (JP) ..... 2012-054179

(51) Int. Cl.
*B41J 2/175* (2006.01)
*B41J 2/14* (2006.01)

(52) U.S. Cl.
USPC ..... 347/85; 347/49

(58) Field of Classification Search
USPC ..... 347/49, 84, 85
See application file for complete search history.

(56) References Cited

U.S. PATENT DOCUMENTS

| | | | | |
|---|---|---|---|---|
| 5,359,357 | A * | 10/1994 | Takagi et al. | 347/49 |
| 7,597,416 | B2 * | 10/2009 | Takata | 347/17 |
| 2006/0274131 | A1 | 12/2006 | Noguchi et al. | |
| 2011/0164077 | A1 | 7/2011 | Masunaga | |
| 2012/0306950 | A1 | 12/2012 | Kobayashi et al. | |
| 2013/0002743 | A1 | 1/2013 | Masunaga | |

FOREIGN PATENT DOCUMENTS

| | | |
|---|---|---|
| JP | H03-247460 | 11/1991 |
| JP | 2001-219570 | 8/2001 |
| JP | 2007-105863 | 4/2007 |
| JP | 2011-037235 | 2/2011 |
| JP | 2011-230416 | 11/2011 |

* cited by examiner

*Primary Examiner* — Anh T. N. Vo
(74) *Attorney, Agent, or Firm* — Cooper & Dunham LLP

(57) ABSTRACT

An image forming apparatus includes a recording head including plural nozzles discharging liquid droplets; a head tank supplying liquid to the recording head; plural head holders each holding one or more recording heads and head tanks; a carriage exchangeably supporting the plural head holders; a main tank storing liquid to be supplied to the head tank; and plural liquid supply tubes supplying the liquid from the main tank to the head tank. Further, the plural liquid supply tubes are branched into plural groups corresponding to the plural head holders at the carriage and are connected to corresponding head tanks.

5 Claims, 9 Drawing Sheets

IMAGE FORMING APPARATUS

CROSS-REFERENCE TO RELATED APPLICATIONS

The present application claims priority under 35 U.S.C. §119 to Japanese Patent Application No. 2012-054179 filed Mar. 12, 2012, the entire contents of which are hereby incorporated herein by reference.

BACKGROUND OF THE INVENTION

1. Field of the Invention

The present invention generally relates to an image forming apparatus, more specifically to an image forming apparatus including a carriage on which a recording head ejecting liquid droplets is mounted.

2. Description of the Related Art

As an image forming apparatus such as a printer, a facsimile machine, a copier, a plotter and the like, there has been a known an image forming apparatus (e.g., an inkjet recording device) employing a liquid discharge recording method using a recording head including a liquid discharge head (liquid droplet discharge head) discharging liquid droplets.

When an image is formed in the image forming apparatus employing such a liquid discharge recording method, the image quality may be greatly influenced by a landing accuracy of liquid droplets (i.e., accuracy of ink landing positions on a recording sheet or the like) discharged from nozzles. Namely, if the landing accuracy of liquid droplets is low, the image quality may be degraded accordingly. Therefore, it is desired that the position of the recording head is determined with high accuracy.

On the other hand, for example, when an ejection failure occurs in the recording head, it may be desired that the recording head may be easily exchanged under the use environment. To that end, it is also desired that the recording head may be exchanged with a higher accuracy regarding the position of the recording head.

There has been known a recording head providing a higher accuracy of position determination when exchanging the recording head and including a head holder on which plural liquid ejection heads are mounted and a carriage which detachably supports the head holder (see Japanese Laid-open Publication No. 2011-037235).

SUMMARY OF THE INVENTION

According to an aspect of the present invention, an image forming apparatus includes a recording head including plural nozzles discharging liquid droplets; a head tank supplying liquid to the recording head; plural head holders each holding one or more recording heads and head tanks; a carriage exchangeably supporting the plural head holders; a main tank storing liquid to be supplied to the head tank; and plural liquid supply tubes supplying the liquid the main tank to the head tank. Further, the plural liquid supply tubes are branched into plural groups corresponding to the plural head holders at the carriage and are connected to corresponding head tanks.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In related art, there is an image forming apparatus including plural head holders mounted on a carriage. In such configuration, when the head holder is to be exchanged, it may be necessary to remove a liquid supply tube for supplying liquid to a head side. Therefore, it is desired to provide a configuration that may allow a user to perform the exchange process effectively (easily).

The present invention is made in light of the above problem, and may provide an exchange process facilitating the exchanging of the head holders.

In the following, embodiments of the present invention are described with reference to the accompanying drawings.

Figure 2:
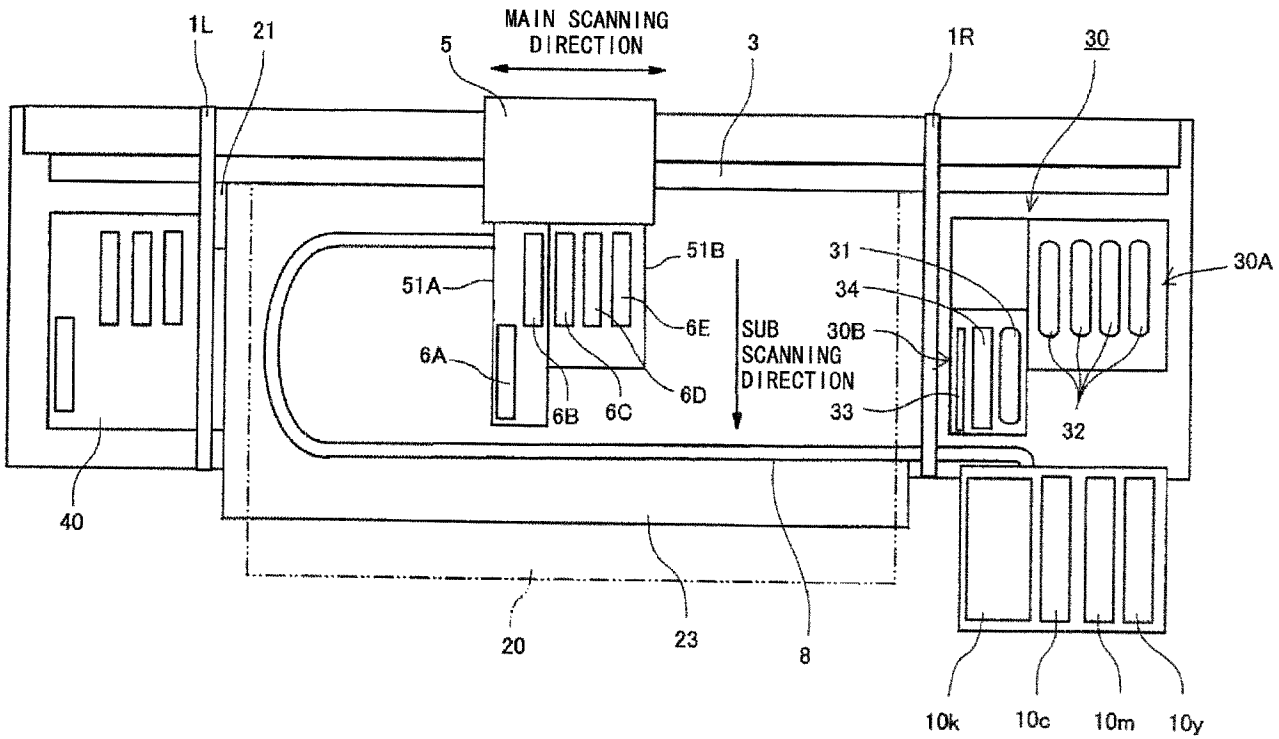
FIG. 2 is a top view of a mechanical part of the image forming apparatus of FIG. 1.
Figure 3:
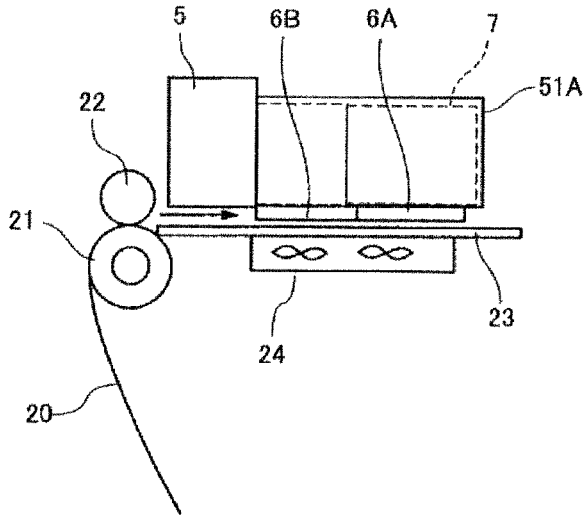
FIG. 3 is side view of the mechanical part of FIG. 2.

First, an example image forming apparatus according to a first embodiment is described with reference to FIGS. 1 through 3.

Figure 1:
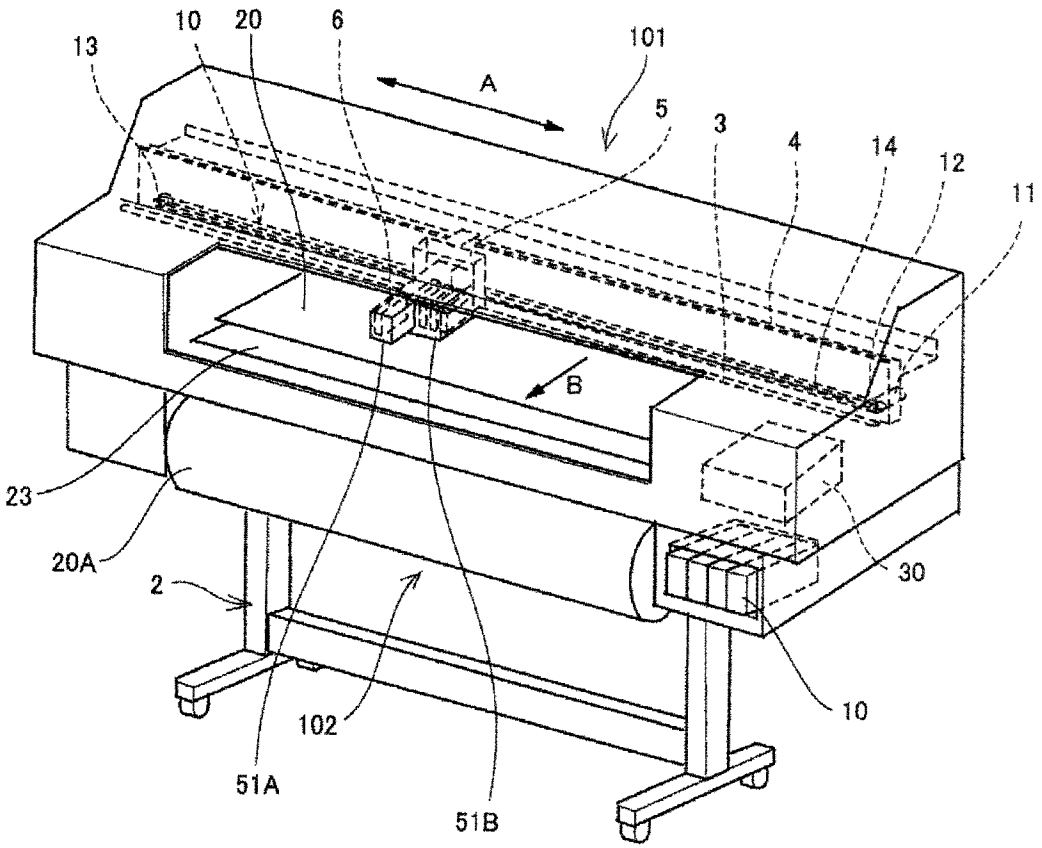
FIG. 1 is a perspective view of an example image forming apparatus according to a first embodiment.

FIG. 1 is a perspective view of the image forming apparatus. FIG. 2 is a top view of a mechanical part of the image forming apparatus. FIG. 3 is a side view of the mechanical part.

This image forming apparatus is a serial type and includes an apparatus main body 101 and a sheet, supply device 102.

The apparatus main body 101 includes a pair of side plates 1L and 1R (FIG. 2), a main guide member 3 and a sub guide member 4 which are bridged between the side plates 1L and 1R, and a carriage 5 slidably provided along the main guide member 3 and the sub guide member 4 in the main scanning direction (arrow A direction in FIG. 1).

Further, a main scanning mechanical part to move and scan the carriage 5 includes a drive motor 11 disposed on one side in the main scanning direction, a driven pulley 13 and a driving pulley 12 which are disposed on the other side in the main scanning direction, and a timing belt 14 which is stretched between the driven pulley 13 and the driving pulley 12 and serves as a traction member.

Further, a head holder 51A for black color and a head holder 51B for colors are exchangeably (detachably) provided and supported by the carriage 5.

The head holder 51A includes two recording heads 6A and 6B which are disposed in an offset manner (FIG. 4) in the sub scanning direction and discharges (ejects) black liquid droplets.

The head holder 51B includes three recording heads 68, 6D, and 6E which are arranged in parallel in the same position in the sub scanning direction and discharge liquid droplets in cyan, magenta, and yellow colors, respectively.

Further, the number of recording heads 6 (which is a symbol collectively expressing the recording heads 6A through 6E) supporting the head holder 51A and the head holder 51B may be, for example, one.

Further, in each of the recording heads 6, a head tank 7 for supplying ink to the recording head 6 is integrally provided. The term "integrally" indicates that the recording head 6 is directly connected to a flow path of the head tank 7 and that recording head 6 is (indirectly) connected to the head tank 7 via, for example, a tube.

Further, black, cyan, magenta, and yellow inks are supplied from the ink cartridges 10*k*, 10*c*, 10*m*, and 10*y*, which are that main tanks exchangeably mounted on the apparatus main body 101, to the head tanks 7 via respective liquid supply tubes 8.

On the other hand, to feed a roll sheet 20, which is supplied from a roll body 20A in the sheet supply device 102, in the sub scanning direction (i.e., the arrow B direction in FIG. 1), there is provided a feeding unit.

The feeding unit includes a feeding roller 21 that adsorbs the roll sheet 20 and feeds the roll sheet 20 at the position where the feeding roller 21 faces the recording head 6, a pressing roller 22 that presses and contacts the feeding roller 21, a platen member 23 facing the recording head 6, and a suction fan 24 that adsorbs the roll sheet 20 via a suction hole of the platen member 23.

Further, on the one side of the carriage 5 in the main scanning direction, there is provided a maintenance and recovery unit 30 which is a maintenance and recovery mechanism performing a maintenance and recovery process on the recording head 6.

On the other side of the carriage 5, there is provided a preliminary discharge receiver 40 for preliminarily discharging liquid droplets which do not contribute to image forming from the recording head 6.

The maintenance and recovery unit 30 includes a first maintenance and recovery unit 30A supported by the apparatus main body 101 and a second maintenance and recovery unit 30B which is supported slidably back and forth in the sub scanning direction (FIG. 1).

The first maintenance and recovery unit 30A includes moisturizing caps to cap the nozzle surfaces (surfaces on which the nozzles are formed) of the recording heads 6B through 6E.

The second maintenance and recovery unit 30B includes a suction cap 31 serving as the moisturizing cap to cap the nozzle surface (surface on which the nozzles are formed) of the recording head 6A, a wiper member 33 to wipe the nozzle surface, and a preliminary discharge receiver 34 to receive liquid droplets which do not contribute to image forming (preliminary discharge droplets).

In the image forming apparatus including such a configuration, the roll sheet 20 is supplied from the sheet supply device 102 and is fed in the sub scanning direction while being adsorbed on the platen member 23 by the feeding roller 21 and the pressing roller 22.

Then, by moving the carriage 5 in the main scanning direction and driving the recording heads 6 in accordance with a image signal, liquid droplets are discharged on the roll sheet 20 which is stopped to record one line data.

Then, the roll sheet 60 (P) is further fed by a predetermined amount (distance), and the data in the next line are recorded. Then, the roll sheet 20 is sequential discharged.

Next, a supporting structure of the head holder and an exchange of the head folder are described with reference to FIGS. 4 and 5.

Figure 4:
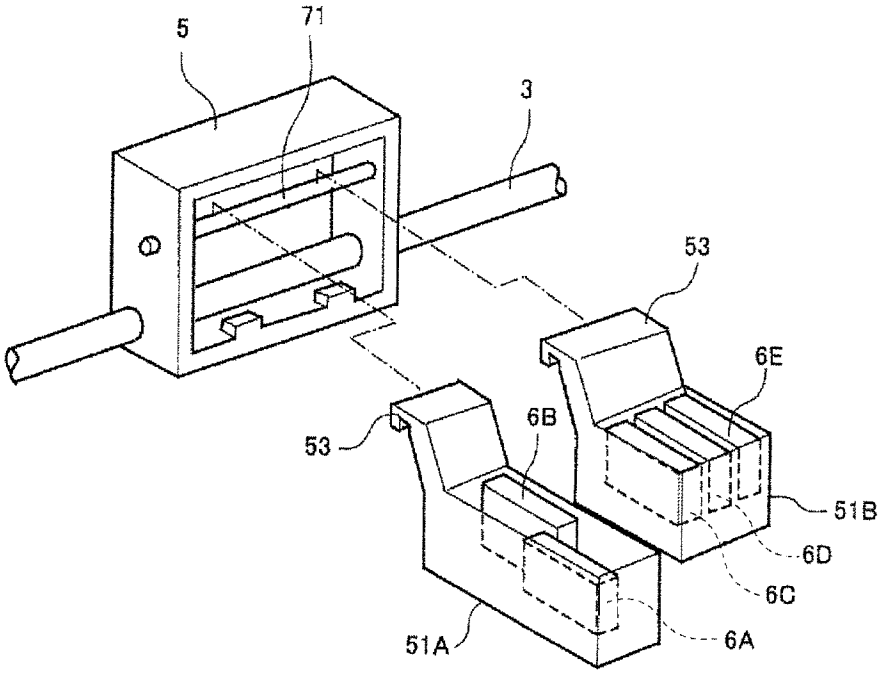
FIG. 4 is a perspective view illustrating a supporting mechanism of a head holder and a state head holders are to be supported by the carriage in an exchange process of the head holders.
Figure 5:
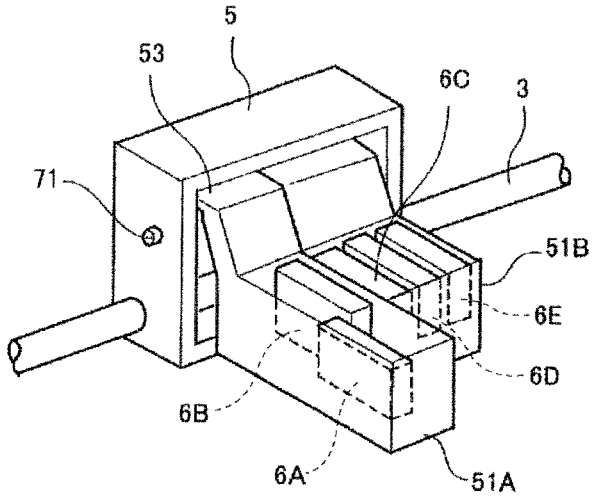
FIG. 5 is a perspective view illustrating a state where the head holders are supported by the carriage.

FIG. 4 is a perspective view of a state before the head holders are supported by the carriage. FIG. 5 is a perspective view of a state where the had holders are supported by the carriage. In the figures, it is assumed that the recording head includes the head tank.

As described above, the head holder 51A for black color and the head holder 51B for colors are exchangeably (detachably) provided and supported by the carriage 5. Further, the recording heads 6A and 6B are provided (mounted) in the head holder 51A; and three recording heads 6C, 6D, and 65 are provided in the head holder 52B.

Here, in the carriage 5, there is provided a reference axle member 71 serving as a reference member extending in the same direction as that of the main guide member 3. Further, the head holders 51A and 51B (hereinafter may be simplified as a "head Solder 51" when it is not necessary to distinguish those head holders 51A and 52B) include respective hook parts 53 having a hook shape so that the head holders 51A and 51B are attached to and detached from the reference axle member 71.

Namely, by hooking the hook part 53 of the head holders 51A and 51B, the head holders 51A and 51B are supported by the carriage 5. Further, for example, the reference axle member 71 may have a cylindrical or polygonal shape.

By having the structure described above, the head holder 51A for black color and the head holder 51B for colors may be exchanged separately. The service life time of the recording heads 6A though 6E may be different from each other depending on the frequency of using color printing and monochrome printing and the like.

Due to the above configuration where it is possible to exchange only the head holder which is required to be exchanged, the running cost thereof may be reduced.

Further, regarding the positional accuracy of the recording head in the head holders 51A and 51B, by using a fixture in a process, it is possible to obtain high accuracy. For example, the recording head may be mounted on the head holder by performing an image processing on nozzle holes or any target part which may serve as a reference with respect to the nozzle holes.

By doing this, high positional accuracy may be obtained because a frame of the recording head is not used as a reference but the nozzles holes or the like are directly used as a reference in adjusting the position of the recording heads relative to the head holder.

Figure 6:
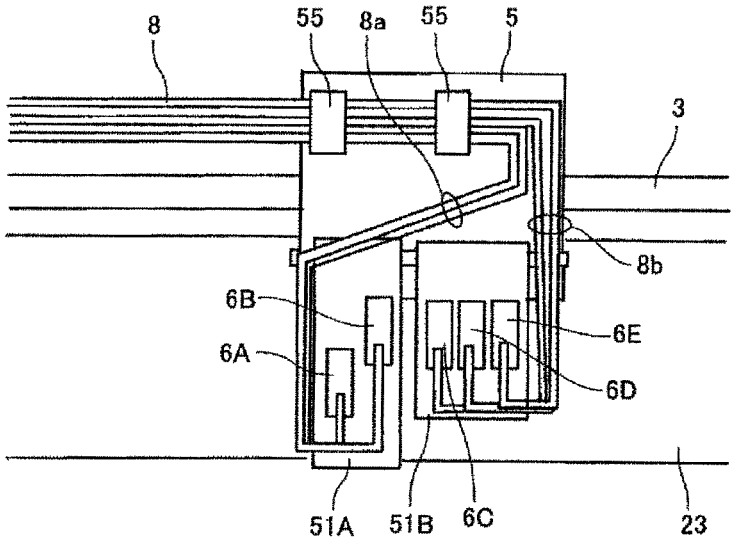
FIG. 6 is a top view of a carriage part where liquid supply tubes are placed around (arranged) in the carriage.

Next, a state of how the liquid supply tubes are to be placed around (arranged) in the carriage according to an embodiment is described with reference to FIG. 6. FIG. 6 schematically illustrates a carriage part for description.

As described above, there are plural liquid supply tubes 8 that supply liquid from ink cartridges 10 side to the head tanks 7 of the recording heads 6, respectively. The plural liquid supply tubes 8 are placed (arranged) around and supported by supporting members 55 such as clamps.

After that, on the downstream side of the supporting members 55, the plural liquid supply tubes 8 are branched (separated) into two groups which are a liquid supply tube group 8*a* connected to the head tanks 7 of the recording heads 6A and 66 in the head holder 51A and a liquid supply tube group 8*b* connected to the head tanks 7 of the recording heads 6C through 6E in the head holder 51B.

Further, the liquid supply tube group 8*a*, which is one of the two separate groups, is placed around (arranged) on the side opposite to the side where the head holder 51A faces the head holder 51B and is connected to the respective head tanks 7 of the recording heads of 6A and 6B.

Similarly, the liquid supply tube group 8*b*, which is the other one of the two separate groups, is placed around on the side opposite to the side where the head holder 51B faces the head holder 51A and is connected to the respective head tanks 7 of the recording heads of 6C through 6E.

Figure 7:
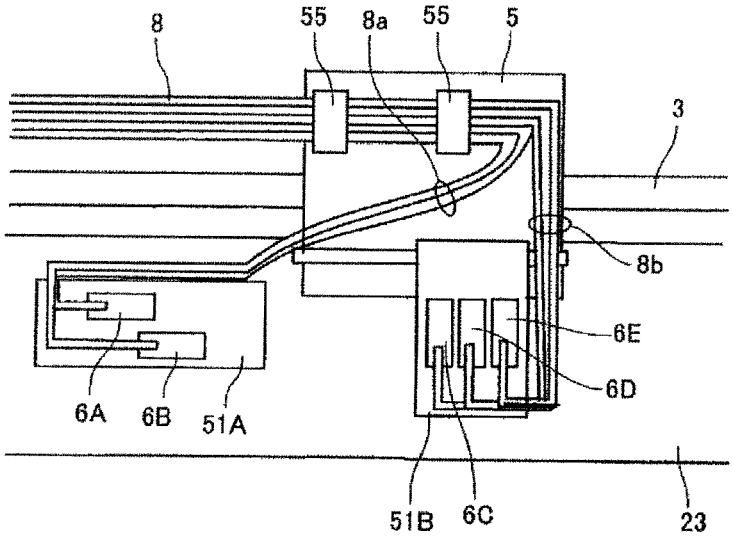
FIG. 7 is a top view of a carriage part for describing the procedure of head holder exchange.

Next, an exchange procedure of exchanging the head holder according to an embodiment is described with reference to FIGS. 7 and 8.

For example, a case is described where the head holder 51A is exchanged. As shown in FIG. 7, first, the head holder 51A is removed from the carriage 5 while the liquid supply tubes 8 thereof remain connected to the head tanks 7 and is temporarily placed on the platen member 23 or the like.

Figure 8:
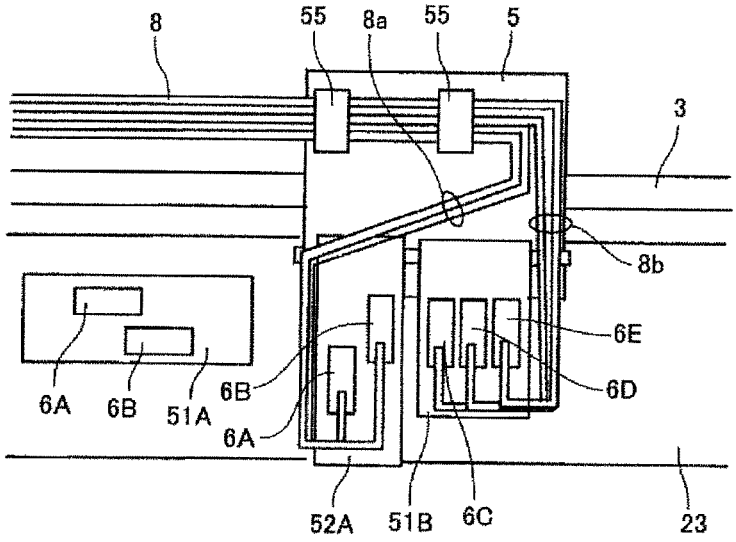
FIG. 8 is another top view of the carriage part for describing the procedure of the head holder exchange.

Next, as shown in FIG. 8, a new head holder 52A (the same holder as the head holder 51A) is set to the carriage 5; and then, the liquid supply tubes 8 and respective connecting tubes (connecting the liquid supply tubes and the corresponding head tanks 7) are removed from the head holder 51A and are directly connected to the new head holder 52A.

By doing this, it may not be required to prepare and use any new sealing member. Therefore, the cost may be lower and the exchange operation may be easier. Namely, a joint in related art may include a needle and a valve so as to provide a mechanism whereas liquid may be shut off from air when the joint is removed. Therefore, the cost of using such a joint may be higher.

Further, when the recording head 6 is placed directly on the platen member 23, the platen member 23 may be blemished. Therefore, a sheet may be placed or a nozzle sealing member to seal the nozzles may be used.

Further, when a new recording head 6 and the head tank 7 are filled with liquid, a nozzle sealing member and a supply port sealing member to seal the supply port may be generally Therefore, by using those member the exchanged recording head, it may become possible to use such new members.

Figure 9:
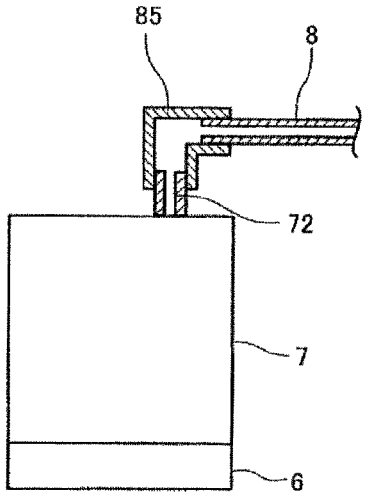
FIG. 9 is a side view of a connection part between a head tank and the liquid supply tube according to a second embodiment.

Next, a second embodiment of the present on with reference to FIG. 9.

FIG. 9 is a side view illustrating the connecting part connecting the head tank 7 and the liquid supply tube 8 according to this embodiment.

In this embodiment, a connecting member (connecting tube or flexible tube) 85 is used to connect the supply port part 72 of the had tank 7 and the liquid supply tube 8.

By using the connecting tube 85, the parts configuration may be simplified, and parts such as an O-ring and a member to squeeze the O-ring may no longer be necessary. As a result, cost may be reduced.

Figure 10:
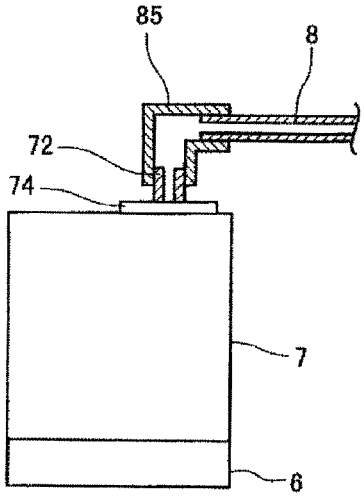
FIG. 10 is another side view of the connection part between the head tank and the liquid supply tube according to a third embodiment.

Next, a third embodiment of the present invention is described with reference to FIG. 10. FIG. 10 is a side view illustrating the connecting part connecting the head tank 7 and the liquid supply tube 8 according to this embodiment.

In this embodiment, in the vicinity of the supply port part 72 of the head tank 7, there is disposed a suction member 74.

By having the suction member 74, it may become possible to prevent damage to the recording head by ink leaked when the connecting tube 85 is attached to or detached from the supply port part 72 of the head tank 7.

Figure 11:
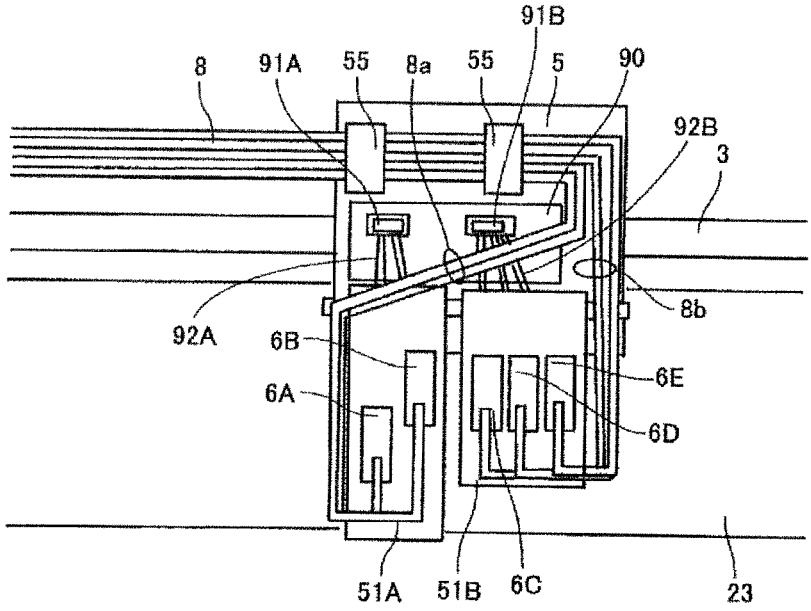
FIG. 11 is a top view of the carriage part according to a fourth embodiment.

Next, a fourth embodiment of the present invention is described with reference to FIG. 11. FIG. 11 is a side view of the carriage part according to the embodiment.

In this embodiment, the carriage 5 includes a carriage side substrate 90 that is connected to a control substrate on the apparatus main body side. Further, the carriage side substrate 90 includes connectors 91A and 91B so which are to be in electronic contact with the head holders 51A and 52B, respectively.

Further, the recording head 6 of the recording head 51A is connected to the connector 91A using a wiring member (harness) 92A, and the recording head 6 of the recording head 51B is connected to the connector 91B using a wiring member (harness) 92B.

Further, on the recording head 6 side, there are devices such as a head drive circuit, a thermistor, a liquid surface detecting unit and the like. Those devices are electronically connected to the carriage side substrate 50.

Generally, it may be difficult to remove or connect a connector while the had holders 51A and 51B are being supported by the carriage 5.

On the other hand, by having the configuration described above according to this embodiment, it may become possible that the electronic connection of the head holder 51A or 51B is independently separated.

Therefore, it may possible to that the operations of separating the harness from the head holder to be replaced after separating the head holder from the carriage 5 and connecting the harness to a new head holder at a spacious area before the new head holder is connected to the carriage 5.

Namely it may become easier to exchange the recording head because, for example, it is possible to disconnect the wiring member (harness) 92A from the connector 91A and exchange the recording heads 6A and 6B at a spacious area.

Figure 12:
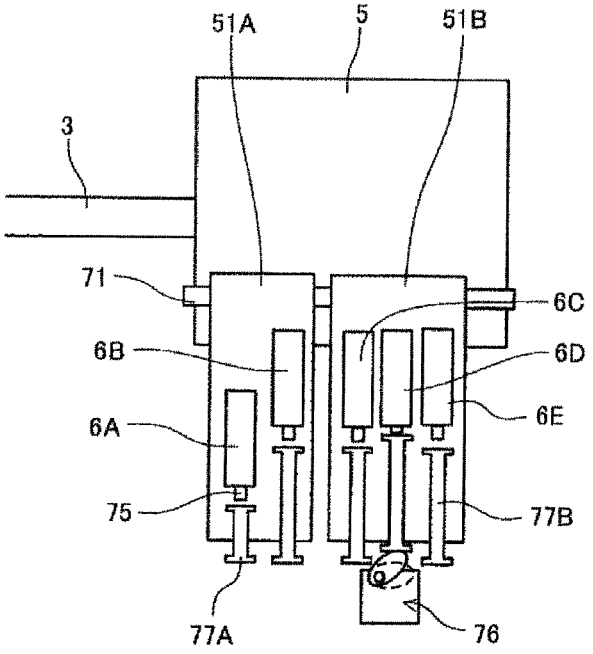
FIG. 12 is a top view of the carriage part according to a fifth embodiment.

Next, a fifth embodiment of the present invention is described with reference to FIG. 12. FIG. 12 is a top view of the carriage part according to this embodiment.

In this embodiment, the head tank 7 includes an open air valve 75 exposing inside to air. Further, on the apparatus main body side, there is provided an actuator unit 76 to drive the open air valve 75 via a relay member 77, so that the open air valve 75 exposes the inside to air.

Here, the relay member 77 has a length corresponding to the position of the head tank 7 in the sub scanning direction.

As described above, in accordance with the positions of the recording heads 7 corresponding to the recording heads 6 which are arranged in an offset manner, by using a shorter relay member 77A disposed closer to the actuator unit 76 and using a longer relay member 77B disposed farther from the actuator unit 76, it may become possible to reduce the number of the actuator units thereby reducing the cost.

Further, in this application, the material of the term "sheet" is not limited to a paper. The sheet may further include an Over Head Projector (OHP) sheet, fiber, glass, board and the like to which liquid such as link droplets may be attached.

Further, the terms "image forming", "recording", "printing characters", "printing pictures", and "printing" are supposed to be synonyms.

Further, the term "image forming apparatus" herein refers to an apparatus that discharges liquid on a medium including paper, string, fiber, silk, leather, metal, plastic, glass, wood, ceramic and the like to form an image.

Further, the term "image forming" herein refers to not only applying meaningful character, figure or the like to a medium but also applying even a meaningless image such as patterns to the medium (including just landing the liquid droplets on the medium).

Further, unless otherwise described, the term "ink" herein is not limited to a material that may be called "ink", but is used as a collective term of any liquid that may be used for image forming, the liquid including a DNA sample, resist, pattern material, resin and the like, the collective term including recording liquid, fixing processing liquid, liquid and the like.

Further, herein, the term "image" is not limited to a planer image but includes an image applied to (formed on) a cubic object or an image formed by forming an object in three-dimensional shape after an original image is applied.

Further, the present invention may not only be applied to an image forming apparatus employing a vertical discharging method in which the recording head discharges liquid droplets in the vertical downward direction but also an image forming apparatus employing a horizontal discharging method in which the record head discharges liquid droplets in the direction orthogonal to the vertical direction or in the direction crossing in the vertical direction.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a recording head including plural nozzles discharging liquid droplets;

a head tank configured to supply liquid to the recording head;

plural head holders each holding one or more recording heads and head tanks;

a carriage configured to exchangeably support the plural head holders;

a main tank configured to store liquid to be supplied to the head tanks; and plural liquid supply tubes configured to supply the liquid from the main tank to the head tanks, wherein the plural liquid supply tubes are bundled together from the main tank to the carriage and branched into plural groups corresponding to the plural head holders at the carriage and are connected to corresponding head tanks.

2. The image forming apparatus according to claim 1, wherein the plural head holders include first and second head holders which are arranged side by side along a moving direction of the carriage, wherein the plural liquid supply tubes are branched into first and second groups at the carriage, wherein liquid supply tubes branched into the first group are arranged on a first side of the first head holder, the first side being opposite to a second side of the first head holder, the second side of the first head holder facing a first side of the second head holder, and wherein liquid supply tubes branched into the second group are arranged on a second side of the second head holder, the second side being opposite to the first side of the second head holder.

3. The image forming apparatus according to claim 1, further comprising:

a flexible connecting member provided between the head tanks and one of the plural liquid supply tubes.

4. The image forming apparatus according to claim 1, wherein the head tank includes a suction member disposed on a connecting part with, one of the plural liquid supply tubes.

5. The image forming apparatus according to claim 1, further comprising:

a carriage side substrate formed on the carriage, wherein the carriage side substrates includes connectors that are configured to be connected to electric wirings connected to the plural head holders, respectively.

* * * * *